United States Patent [19]

Schäfer

[11] 4,248,596

[45] Feb. 3, 1981

[54] PROCESS FOR THE FELTPROOF FINISHING OF TEXTILES MADE OF KERATIN-CONTAINING FIBERS

[75] Inventor: Karl Schäfer, Leverkusen, Fed. Rep. of Germany

[73] Assignee: Bayer Aktiengesellschaft, Leverkusen, Fed. Rep. of Germany

[21] Appl. No.: 66,137

[22] Filed: Aug. 13, 1979

[30] Foreign Application Priority Data

Aug. 24, 1978 [DE] Fed. Rep. of Germany ..... 2837083

[51] Int. Cl.[3] ..... D06M 15/52; D06M 3/06; D06M 13/46

[52] U.S. Cl. ..... 8/127.6; 8/115.5; 8/115.6; 8/128 A; 8/DIG. 11

[58] Field of Search ..... 8/128 A, 127.6, DIG. 11, 8/115.5, 115.6

[56] References Cited

U.S. PATENT DOCUMENTS

| | | | |
|---|---|---|---|
| B 389,304 | 1/1976 | Schafer et al. | 8/128 A |
| 3,898,197 | 8/1975 | Guise et al. | 8/128 A |
| 3,984,365 | 10/1976 | Lienert et al. | 8/128 A |
| 3,989,458 | 11/1976 | Guise | 8/128 A |
| 4,071,313 | 1/1978 | Guise | 8/128 A |
| 4,124,553 | 11/1978 | Guise | 8/128 A |
| 4,144,268 | 3/1979 | Guise | 8/128 A |

FOREIGN PATENT DOCUMENTS

| | | |
|---|---|---|
| 68419 | 10/1975 | Australia . |
| 1131006 | 5/1967 | United Kingdom . |

*Primary Examiner*—Joseph L. Schofer
*Assistant Examiner*—Herbert J. Lilling
*Attorney, Agent, or Firm*—Gene Harsh; Lawrence S. Pope

[57] ABSTRACT

This disclosure is concerned with an improved process of treating keratin-containing fiber materials with aqueous solutions of polyisocyanate bisulphite adducts to improve their resistance to felting and shrinkage. The material is pretreated with an aqueous bath containing both a compound carrying a cationic group and the salt of a polyvalent metal or the material is pretreated with just the cationic compound but the polyvalent metal salt is present in the aqueous bath used to apply the bisulphite adduct.

10 Claims, No Drawings

PROCESS FOR THE FELTPROOF FINISHING OF TEXTILES MADE OF KERATIN-CONTAINING FIBERS

FIELD OF THE INVENTION

This invention relates to an improved process for the feltproof finishing of keratin-containing textile materials such as wool or mixtures of wool with other natural fibers by treatment of the textile with polyisocyanates which are blocked with bisulphite groups.

BACKGROUND OF THE INVENTION

Addition products of bisulphites and prepolymers containing isocyanate groups and the use of aqueous solutions of such adducts for the shrinkproof and feltproof finishing of keratin-containing textiles have been disclosed, for example, in German Offenlegungsschrift No. 2,307,563 (similar to U.S. Pat. No. 3,898,197) and German Auslegeschrift No. 2,414,470 (similar to U.S. Pat. No. 3,984,365). In the known processes, the textile material is impregnated with a relatively concentrated solution of the bisulphite adduct (e.g. by immersion, spraying or brush coating) and then freed from excess impregnating substance by squeezing. The process has the disadvantage that may manufacturers lack the necessary machinery. Moreover, certain textile materials, e.g. flannel-finished knitted goods based on keratin-containing fibers, can only be treated in long baths. There is, therefore, a need for a process by which the keratin-containing textile can be treated with the above-mentioned bisulphite adducts in a long aqueous bath.

In practice, however, it is found that it is not so easily possible to apply bisulphite adducts of polyisocyanates to textiles by a process of absorption from a long bath. The reason for this is that the bisulphite adducts are only slowly and incompletely absorbed on the textile material from dilute aqueous solutions. This applies particularly to the slightly alkaline baths which are used in practice in order to accelerate the cross-linking reaction of the bisulphite adduct during the subsequent heat treatments of the textile. While U.S. Pat. No. 3,898,197 does refer to exhaustion of bisulphite adducts from acidic long aqueous baths, it does not suggest pretreating the substrate.

It has now been found that textile materials based on keratin-containing fibers can be given a felt-free finish by a process of absorption from long baths of aqueous solutions of polyisocyanate/bisulphite addition products if the textile is first pretreated with a long aqueous bath containing relatively high molecular weight compounds having cationic groups and organic salts of polyvalent metals such as calcium, magnesium, zirconium, zinc, aluminum or chromium.

The aqueous liquors preferably contain calcium chloride and magnesium chloride in addition to the compounds having cationic groups.

The term "long baths" used in the present invention means that the proportion by weight of the textile material which is required to be treated to the aqueous treatment bath is greater than about 1:8 and preferably in the range of from about 1:10 to 1:60, most preferably from about 1:20 to 1:40.

A process for creaseproofing textiles in which the textile materials are impregnated with solutions or dispersions of isocyanate prepolymers, dried and finally treated with solutions or emulsions of surface-active agents has been disclosed in German Offenlegungsschrift No. 1,619,021 (similar in disclosure to British Pat. No. 1,131,006). Although bisulphite adducts of isocyanate prepolymers are also mentioned as impregnating agents in this process and the compounds which may be used as surface-active agents according to German Offenlegungsschrift No. 1,619,021 also include compounds having cationic groups, the effect of more rapid and more complete absorption of the bisulphite adduct on the keratin-containing textile, which is the basis of the present invention, is not achieved in the process according to German Offenlegungsschrift No. 1,619,021, in which the surface-active agent is only subsequently applied to the textile.

In Australian Patent Application 68419/74, which is a prior publication, cationic compounds are described for the preliminary treatment of keratin-containing textiles to enable them to absorb polyisocyanate/bisulphite addition products. The felt-free effects obtained by this process are, however, very uneven and vary according to the type of textile material and the dye. Thus, for example, satisfactory feltproof effects cannot be obtained by this process if the keratin-containing textile has been dyed with after-chroming dyes or reactive dyes.

There are other processes used in practice in which the polyisocyanate/bisulphite addition product is used together with metal salts, preferably magnesium chloride. The aqueous liquor is in these cases made alkaline, e.g. using ammonia. These processes have the disadvantages of the formation of deposits and precipitates in the treatment bath which cause the formation of patches in the textile material and the accumulation of deposits in the treatment apparatus. Furthermore, the feltproof effects obtained by these processes are unsatisfactory, especially on textiles which have been dyed with after-chroming dyes.

SUMMARY OF THE INVENTION

The present invention relates to a process for the feltproof finishing of textiles made of keratin-containing fibers by means of an aqueous solution of an addition product of a bisulphite and a polyisocynate, characterized in that (a) in a first stage, the textile material is pretreated in a slightly alkaline aqueous long bath with from about 0.05 to 2% by weight, preferably from about 0.1 to 0.5% by weight, based on the weight of the textile, of a compound having at least one cationic group and a molecular weight above about 200, preferably above about 300, which compound has a total of from about 10 to 1,200, preferably from about 20 to 800 milliequivalents of cationic groups per 100 g of solid substance;

(b) in a second stage, the pretreated textile material is treated in a slightly alkaline aqueous long bath with from about 0.25 to 5% by weight, preferably from about 1 to 1.5% by weight, based on the weight of the textile, of an addition product of a bisulphite and a polyisocyanate, preferably at a temperature of from about 50° to 95° C. and rinsed with water; and (c) in a third state, the material is dried by a known method and after-treated with steam, the aqueous bath used in the first and/or second stage preferably in the first stage, containing from about 0.5 to 10 g/l of salts of polyvalent metals, preferably a mixture of calcium chloride and magnesium chloride, most preferably in a proportion by weight of about 1:3.

DETAILED DESCRIPTION OF THE INVENTION

The cationic preliminary treatment agents used may be compounds according to the present invention which have at least one cationic group and the molecular weight of which is at least about 200, preferably more than about 300. These compounds contain a total of from about 10 to 1,200, preferably from about 20 to 800 milliequivalents of ionic groups per 100 g of solid substance. Particularly suitable compounds of this type are ammonium salts, particularly quaternary ammonium compounds. Examples of these are compounds corresponding to the following general formula:

$$\left[ C_nH_{(2n+1)}-\overset{\overset{R_1}{|}}{\underset{\underset{R_2}{|}}{N_\oplus}}-R_3 \right] X^\ominus$$

wherein

- n represents an integer of from 6 to 20, preferably from 8 to 14,
- $R_1$ and $R_2$ represent hydrogen or preferably an alkyl group having from 1 to 3 carbon atoms,
- $R_3$ represents an alkyl, cycloalkyl, aryl or aralkyl group having from 1 to 15 carbon atoms and
- X represents any anion, for example a chloride, sulphate, methylsulphate or acetate ion.

One example of such a compound is benzyl dodecyl dimethylammonium chloride.

The compounds used for the first stage of the process according to the present invention may also be relatively high molecular compounds which have recurrent structural units corresponding to the following general formula:

$$\left[ \overset{\overset{R}{|}}{\underset{\underset{R}{|}}{N_\oplus}}-(CH_2)_x-\overset{\overset{R'}{|}}{\underset{\underset{R'}{|}}{N_\oplus}}-(CH_2)_y \right] 2X^\ominus$$

wherein

- R and R' represent, independently of each other, alkyl groups having from 1 to 4 carbon atoms, preferably methyl groups,
- x and y represent, independently of each other, integers of from 2 to 10, preferably from 2 to 4, and
- X is defined as above.

One example of such a compound is the reaction product of tetramethylenediamine and 1,4-dichlorobutane.

Reaction products of polyamines with an excess of fatty acids may also be used, for example products corresponding to the following general formula:

$$\left[ C_mH_{(2m+1)}-CONH-(CH_2)_x-\overset{\overset{R}{|}}{\underset{\underset{R}{|}}{NH_\oplus}} \right] C_mH_{(2m+1)}-COO^\ominus$$

wherein

- m represents an integer of from 8 to 20, preferably from 11 to 18, and
- x and R are defined as above, for example, the reaction product of 3-(dimethylamino)-propylamine and stearic acid.

Quaternary ester imines corresponding to the following general formula:

$$\left[ C_mH_{(2m+1)}-COO(CH_2)_x-\overset{\overset{R}{|}}{\underset{\underset{R}{|}}{N_\oplus}}-R_3 \right] X^\ominus$$

wherein

- m, X, x, R and $R_3$ are defined as above, are also suitable for the process according to the present invention.

The preliminary treatment agents used may also be quaternary reaction products of primary, secondary or tertiary diamines or polyamines, cyclic ether amines (e.g. N-methylmorpholine) or polyamides (e.g. of adipic acid and diethylene triamine) with epichlorohydrin, such as described, for example, in German Offenlegungsschriften Nos. 1,771,043 and 1,906,450 (U.S. Pat. No. 3,640,840, incorporated herein by reference), and German Auslegeschriften No. 1,177,824 (U.S. Pat. Nos. 2,926,116, incorporated herein by reference), 1,771,814 (U.S. Pat. Nos. 3,893,885, incorporated herein by reference) and 1,546,369.

Reaction products of polyvalent amines with epoxy resins, e.g. those according to British Pat. No. 933,729, are also suitable.

Polymer dispersions containing cationic groups, e.g. those described for the finishing of wool in U.S. Pat. No. 3,925,581 (incorporated herein by reference) may also be used in the process according to the present invention for the pretreatment of fiber material.

The known polyurethanes having cationic groups which are soluble or dispersible in water are also particularly suitable for the process according to the present invention, for example, the compounds described in German Pat. Nos. 1,178,586; 1,179,363; 1,184,946; 1,187,012 and 1,300,275 and in German Offenlegungsschriften Nos. 2,551,094; 2,651,506; 2,651,505; 2,659;617; 2,725;589; 2,730,514; 2,732,131 and 2,734,567 and in the survey reports given by D. Dieterich and H. Reiff in "Die Angewandte Makromolekulare Chemie", 26, (1972), pages 85 to 106, by D. Dieterich in "Angewandte Chemie", 82, (1970), pages 53 to 63 and by D. Dieterich et al in J. Oil. Col. Chem. Assoc, 1970, 53, pages 363 to 379. A comprehensive survey of the literature is also given in these reports.

Phosphonium compounds, for example 3,4-dichlorobenzyl-triphenyl-phosphonium chloride, are also suitable cationic preliminary treatment agents according to the present invention. Particularly suitable phosphonium compounds are those in which the phosphonium groups are built into a polyurethane matrix. Cationic polyurethanes of this type as well as polyurethanes having the sulphonium groups which are suitable for the present invention have been described in detail in German Offenlegungsschriften No. 1,916,331 (U.S. Pat. Nos. 3,686,026, incorporated herein by reference) and 2,243,159.

The addition products of bisulphite and polyisocyantes to be used in the process according to the present invention are known. They are described for example, in some detail, in the above-mentioned German Offenlegungsschriften Nos. 1,619,021 and 2,307,563 (U.S. Pat. No. 3,898,197 incorporated herein by reference) as well as in German Auslegeschrift No. 2,414,470 and U.S. Pat. No. 3,984,365, incorporated herein by reference.

The isocyanate components used are preferably aliphatic, cycloaliophatic or araliphatic polyisocyanates, e.g. tetramethylenediisocyanate, hexamethylene diisocyanate, 1,4-cyclohexanediisocyanate, hexahydrotolylene diisocyanate, 4,4'-diisocyanato-dicyclohexylmethane, 1-isocyanato-3,3,5-trimethyl-5-isocyanatomethylcyclohexane or p-xylylene diisocyanate or also polyisocyanates containing urethane or biuret groups, e.g. the reaction product of 3 mols of hexamethylene diisocyanate with 1 mol of water. Aromatic diisocyanates such as p-phenylenediisocyanate, tolylene diisocyanates and diphenylmethanediisocyanates are less suitable for the purpose of the present invention. The isocyanate components preferably used according to the invention are isocyanate group-containing prepolymers of the type obtained by the reaction of water or a polyhydroxyl compound with an excess of one of the polyisocyanates mentioned above. The polyols used in this connection, apart from low molecular glycols and triols and polyester polyols, are preferably difunctional or trifunctional polyhydroxyl polyethers having molecular weights of from 500 to 10,000, in particular from 1,000 to 5,000, which may be obtained by known methods of alkoxylation of difunctional or trifunctional starter molecules such as water, ethylene glycol, 1,2-propanediol, 1,3-propanediol, trimethylolpropane or glycerol. Polyether polyols and ethylene oxide are particularly preferred according to the present invention.

Further details about the bisulphite-blocked polyisocyanates used according to the present invention may be found in the documents mentioned above.

In the first stage of the process according to the present invention, the textile based on keratin-containing fibers is first subjected to a preliminary treatment with the cationic compounds described above by a process of absorption in a long aqueous bath. The bath also contains salts (preferably chlorides, sulphates or acetates) or polyvalent metals (preferably from the 2nd to 4th Main or sub-Group of the Periodic system of Elements), for example, magnesium chloride, magnesium sulphate, calcium chloride, aluminum sulphate, zinc sulphate, zinc acetate or zirconium acetate. Preferably, calcium chloride and magnesium chloride are used in quantities of about 1 g/l of $CaCl_2.6H_2O$ and about 3 g/l of $MgCl_2.6H_2O$. The quantities of salt may be reduced or increased according to the nature of the textile to be treated and are in the ranges of from about 0.5 to 10 g/l of water.

The aqueous liquor is made slightly alkaline, i.e. its pH is adjusted to a value of from about 7.1 to 9, preferably about 8, for example by the addition of sodium bicarbonate or sodium carbonate. The treatment bath preferably contains from about 0.5 to 4 g, preferably about 1.5 g of sodium bicarbonate in 1 liter of water.

The quantity of cationic substances to be used according to the present invention is generally from about 0.05 to 2% by weight, preferably from about 0.1 to 0.5% by weight, based on the weight of the textile.

The optimum quantity of cationic preliminary treatment agent may be determined by a preliminary test in each case. The use of an excess quantity of cationic substance for treatment of the textile material should be avoided because this considerably reduces the feltproofing effect of the subsequent treatment with the bisulphite adduct. Any excess cationic substance, however, can easily be removed by rinsing with water.

If desired, the first stage of the treatment may be carried out using the cationic substance alone, the treatment according to the invention with bisulphite-blocked isocyanate prepolymers being carried out in the second stage together with the polyvalent metal salts (preferably calcium chloride and magnesium chloride in proportion of about 1:3).

The treatment temperature in the first stage of the process is preferably from about 25° to 50° C., most preferably about 40° C. The treatment time in the first stage of the process is preferably from about 20 to 30 minutes.

In the second stage of the process according to the present invention, the aqueous bath contains an addition of from about 0.25 to 5% by weight, preferably from about 1 to 1.5% by weight, based on the weight of the textile, of the addition product of bisulphite and polyisocyanate.

It is particularly advantageous, if in addition to the bisulphite addition product, the treatment bath for the second stage of the process according to the invention contains from about 0.5 to 6% by weight, preferably from about 1 to 1.5% by weight, based on the weight of the textile material, of a polyurethane having anionic groups which is soluble in water or can be dispersed therein without the aid of emulsifiers. Anionic polyurethanes of this type have been described in detail in the literature mentioned above in connection with cationic polyurethanes. Instead of anionic polyurethanes, there may also be used aqueous, non-ionic or anionic dispersions of polymers of copolymers based on vinyl and/or divinyl monomers, for example as described in German Offenlegungsschrift No. 2,243,068. Anionic polyurethane dispersions in particular, however, in many cases show a synergistic action in combination with addition compounds of bisulphites and prepolymers containing isocyanate groups, so that exceptionally good feltproofing and shrinkproofing effects are obtained.

The treatment bath of the second stage is preferably heated to about 50°–90° C., most preferably to about 80° C., in the course of from about 20 to 30 minutes. After-treatment is continued for about 10 to 90 minutes, preferably about 15 minutes after the final temperature has been reached.

When the treatment agent has been completely absorbed on the textile, the textile is rinsed with water. It is then squeezed and dried (preferably at from about 110° to 140° C., most preferably at about 120° C.).

The textile material which has thus been treated according to the invention is then after-treated with steam by a known method (for from about 0.5 to 3 minutes, preferably about 1 minute). The steam is preferably used at a pressure of from about 2 to 6 excess atmospheres, most preferably at about 5 excess atmospheres.

The textile material which has been treated according to the present invention has a pleasant, non-sticky handle and very good resistance to shrinkage and felting when washed or when tested in the Cubex apparatus. Keratin-containing textile material which has been treated according to the invention may be dyed or printed in the conventional manner. This is preferably done by rinsing the textile with water after the second stage of the process according to the invention and dyeing it with conventional wool dyes at boiling point in a fresh bath. The drying and steaming process (third stage of the process according to the present invention)

described above is then usually omitted at this stage and carried out only after dyeing.

The keratin-containing textile material may be treated with hot water at from about 80° to 100° C. to stabilize the surface (madder) and prevent long creases. This hot water treatment may be carried out either before the treatment according to the invention with cationic substances or after the impregnation with the bisulphite adduct.

The following Examples serve to describe the process according to the present invention. Quantities given are parts by weight or percentages by weight unless otherwise indicated.

EXAMPLES

EXAMPLE 1

A woolen fabric weighing 120 g/m$^2$ was given a preliminary fixing treatment of the surface by maddering (treatment with water at 90° C.) and then dyed with Mordant Blue 13 (C.I. 16 680) by a conventional method, dewatered by centrifuging and treated with an aqueous bath by the following method.

The fabric is introduced into a bath containing 0.5%, based on the weight of the fabric, of a 30% aqueous solution of a reaction product of tetramethyl ethylene diamine and 1,4-dichlorobutane corresponding to the following formula:

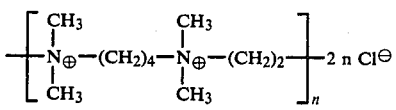

wherein n is about 1,000 and 1 g of calcium chloride.6$H_2O$, 3 g of magnesium chloride. 6$H_2O$ and 1.5 g of sodium carbonate per liter of water (pH-value: 8).

The ratio of treatment bath to weight of fabric is 40:1. The fabric is treated for 20 minutes at 40° C.

3%, based on the weight of the fabric, of a 50% aqueous solution of a bisulphite-blocked isocyanate prepolymer according to Example 2 of U.S. Pat. No. 3,984,365 and 3%, based on the weight of the fabric, of a 40% anionic polyester-polyurethane dispersion are then added.

The anionic polyurethane dispersion was prepared by the reaction of an isocyanate prepolymer obtained from an adipic acid/hexanediol polyester (molecular weight 1,000), butanediol and hexamethylene diisocyanate with the aqueous solution of a mixture of ethylene diamine and the sodium salt of ethylene diaminoethane sulphonic acid. The method used was analogous to that of Example 4 of U.S. Patent Application Ser. No. 161,986 (corresponding to Example 4 of Canadian Pat. No. 928,323) herein incorporated by reference.

The treatment bath was heated to 80° C. in the course of 30 minutes and maintained at this temperature for 15 minutes. The fabric was then rinsed with water, spun, dried at 130° C. and treated with steam at 5 excess atmospheres for one minute.

The treated woolen fabric is found to have a pleasant, non-sticky handle and is very resistant to shrinkage and felting when tested in the Cubex apparatus.

COMPARISON EXPERIMENT A

In contrast to the above, a fabric which has been similarly prefixed and dyed but has been treated with out the addition of the cationic compound undergoes severe felting when tested in the Cubex apparatus. In addition, precipitates which form patches on the treated woolen fabric are formed in the treatment bath.

The fabric is introduced into an aqueous bath containing 6 g of magnesium chloride. 6$H_2O$ per liter. The ratio of treatment bath to weight of fabric is 1:40. The pH of the bath is adjusted to a value of 8 by the addition of ammonia.

The treatment is carried out for 20 minutes at 40° C. 3%, based on the weight of fabric, of the bisulphite-blocked isocyanate prepolymer mentioned above and 3% of the anionic polyester-polyurethane dispersion previously mentioned are then added. The temperature of the bath is raised to 80° C. within 30 minutes and the fabric is treated for a further 15 minutes at this temperature. The pH of the bath is maintained at a value of 8 during treatment. The fabric is then rinsed with water, spun, dried at 130° C. and treated with steam at 5 excess atmospheres.

COMPARISON EXPERIMENT B

In a further experiment, the prefixed and dyed woolen fabric is treated for 20 minutes at 40° C. with 0.7% of the 30% aqueous solution mentioned above of a reaction product of tetramethylethylenediamine and 1,4-dichlorobutane in a bath containing 1.5 g of sodium bicarbonate per liter of water (pH-value: 8).

3%, based on the weight of the fabric, of the 50% solution of a bisulphite-blocked isocyanate prepolymer mentioned above and 3% of the above-mentioned 40% anionic polyester-polyurethane dispersion are then added. The temperature is raised to 80° C. in the course of 30 minutes, and the textile is treated for a further 15 minutes at 80° C. It is then rinsed with water, spun, dried at 130° C. and treated with steam at 5 excess atmospheres.

The woolen fabric treated in the two comparison experiments described above differs from that which has been treated by the process according to the present invention since it is insufficiently resistant to felting when tested in the Cubex apparatus, as is shown in the following Table:

| Shrinkage test by IWS test methods 9 and 185 in the Cubex apparatus | | |
|---|---|---|
| Fabric treated according to the present invention: | 2% | 3% |
| Comparison Experiment A: | 6% | 16% |
| Comparison Experiment B: | 6% | 21% |
| Untreated fabric: | 5% | 70% |
| A = relaxation shrinkage | | |
| B = surface felt shrinkage | | |

EXAMPLE 2

A woolen tricot fabric weighing 440 g per running meter is dyed with 3% Reactive Red (C.I. 154) by a conventional method.

The woolen tricot is then treated according to Example 1 and Comparison Experiments A and B.

The treatment according to the present invention, carried out in the first stage with a reaction product of tetramethyl ethylene diamine and 1,4-dichlorobutane and with calcium chloride and magnesium chloride, results in good freedom from shrinkage and very good resistance to felting according to the Cubex test. In contrast, treatments carried out using the bisulphite-blocked prepolymer with the addition of magnesium chloride alone by analogy with Comparison Experiment A of Example 1 provide poor feltproofing effects and deposits are found in the treatment bath. Treatments carried out in the first stage using the reaction product of tetramethyl ethylene diamine and 1,4-dichlorobutane alone, as in Comparison Experiment B of Example 1, are also insufficiently effective, as is shown in the following Table:

| Shrinkage test by IWS test methods 9 and 185 in the Cubex apparatus | A | B |
|---|---|---|
| Textile material treated according to the present invention: | 3% | 2% |
| Comparison Experiment A: | 4% | 19% |
| Comparison Experiment B: | 4% | 16% |
| Untreated textile material: | 7% | 65% |
| A = relaxation shrinkage | | |
| B = surface felt shrinkage | | |

EXAMPLE 3

A woolen fabric weighing 120 g/m$^2$ is prefixed in its surface by maddering (hot water treatment) and dyed with Mordant Red 30 (C.I. 19360) by a conventional method.

The fabric is dewatered by spinning and treated with 1%, based on the weight of the fabric, of a 20% aqueous dispersion of a reaction product of stearic acid and dimethylaminopropylamine corresponding to the following formula:

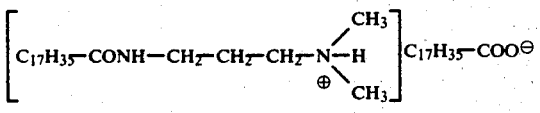

The proportion of treatment bath to weight of fabric is 30:1.

The fabric is treated in the aqueous liquor at 50° C. for 20 minutes. It is then rinsed with water and treated in a second stage using a bath containing 1 g of calcium chloride. $6H_2O$, 3 g of magnesium chloride. $6H_2O$ and 1.5 g of sodium bicarbonate per liter of water. In addition, the liquor contains 3%, based on the weight of the textile, of the bisulphite-blocked isocyanate prepolymer mentioned in Example 1 and 3% of the 40% anionic polyester-polyurethane dispersion from Example 1.

The temperature of the bath is raised from 40° C. to 80° C. within 30 minutes. Treatment is continued for a further 15 minutes at this temperature. The fabric is then rinsed with water, spun, dried at 130° C. and treated with steam at 5 excess atmospheres for one minute. The fabric treated according to the present invention shows good resistance to shrinkage and felting when tested in the Cubex apparatus. The process described in Example 1 (Comparison Experiment A) carried out with the addition of only 6 g of magnesium chloride per liter (without a cation active compound) or a preliminary treatment carried out alone, using the above-mentioned cationic reaction product of stearic acid and dimethylaminopropylamine (without metal salt; Comparison Experiment B) do not provide sufficient feltproofing, as can be seen from the following Table:

| Shrinkage test by IWS test methods 9 and 185 in the Cubex apparatus | A | B |
|---|---|---|
| Textile material treated according to the present invention: | 2% | 3.6% |
| Comparison Experiment A: | 6% | 17% |
| Comparison Experiment B: | 6% | 20% |
| Untreated textile material: | 5% | 70% |
| A = relaxation shrinkage | | |
| B = surface felt shrinkage | | |

EXAMPLE 5

A wool flannel weighing 220 g/m$^2$ is dyed with 3% Mordant Blue 13 (C.I. 16 680) by a known method. When the textile material has been dewatered by spinning after the dyeing process, it is treated in an aqueous bath containing 0.6%, based on the weight of the textile, of the cationic reaction product of tetramethyl ethylene diamine and 1,4-dichlorobutane mentioned in Example 1 and 1 g of calcium chloride. $6H_2O$, 3 g of magnesium chloride. $6H_2O$ and 1.5 g of sodium bicarbonate per liter of water (pH-value: 8).

The ratio of textile material to aqueous bath is 1:40.

The wool flannel is treated at 40° C. for 20 minutes. 2% of the bisulphite-blocked isocyanate prepolymer described in Example 1 and 2% of the 40% aqueous anionic polyester-polyurethane dispersion also described in Example 1 are then added. The treatment is carried out for 15 minutes at 40° C. and the temperature is then raised to 60° C. within 20 minutes. 1 g of sodium bicarbonate in 1 liter of water is added and treatment is continued for 45 minutes at 60° C. The textile material is then rinsed with water, dried at 130° C. and treated with steam at 4 excess atmospheres for one minute.

The wool flannel treated according to the present invention shows very good resistance to shrinkage and felting when tested in the Cubex apparatus.

In further experiments, the dyed wool flannel is treated with an aqueous liquor containing 5 g of magnesium chloride. $6H_2O$ per liter of water, 2% of the bisulphite-blocked isocyanate prepolymer mentioned above and 2% of the above-mentioned polyester-polyurethane dispersion. The pH is adjusted to a value of 8 using ammonia (Comparison Experiment A).

In another experiment (Comparison Experiment B), the aqueous bath only contains 0.6% of the cationic reaction product mentioned above, 1.5 g of sodium bicarbonate per liter, 2% of the bisulphite-blocked isocyanate prepolymer and 2% of the anionic polyester-polyurethane dispersion mentioned above. In both comparison experiments, the process takes place in the same way as in the process according to the invention described first. In contrast to the treatment according to the present invention, these treatments do not provide sufficient feltproof effects. In addition, flocculation occurs in the treatment bath. In still another comparison experiment C the aqueous liquor contained 3 g of magnesium chloride. $6H_2O$, 1 g of calcium chloride. $6H_2O$ and 2 g of sodium bicarbonate per liter, 2% of the bisulphite-blocked isocyanate prepolymer and 2% of the anionic polyester-polyurethane dispersion mentioned above (pH-value: 8). The feltproof effect is considerably poorer than according to the invention. Moreover, there are deposits and flocculations on the treated textiles.

| Shrinkage test according to IWS test methods 9 and 185 in the Cubex apparatus | A | B |
|---|---|---|
| Textile material treated according to the present invention: | 2% | 1% |
| Comparison Experiment A: | 3% | 19% |
| Comparison Experiment B: | 3% | 25% |
| Comparison Experiment C: | 3% | 18% |
| Untreated textile material: | 8% | 30% |
| A = relacation shrinkage | | |
| B = surface felt shrinkage | | |

Although the invention has been described in detail for the purpose of illustration, it is to be understood that such detail is solely for that purpose and that variations can be made therein by those skilled in the art without departing from the spirit and scope of the invention except as it may be limited by the claims.

What is claimed is:

1. A process for the felt free finishing of textiles made of keratin-containing fiber material by means of an aqueous solution of an addition product of a bisulphite and a polyisocyanate, characterized in that (a) in a first stage, the textile material is subjected to a preliminary treatment in a slightly alkaline aqueous long bath which has a textile to treatment ratio greater than 1:8 with from about 0.05 to 2% by weight, based on the weight of the textile, of a compound having a molecular weight of more than about 200 which has at least one cationic group and contains a total of from about 10 to 1,200 milliequivalents of cationic groups per 100 g of solid substance, (b) in a second stage, the pretreated textile material is treated in a slightly alkaline aqueous long bath which has a textile to bath ratio greater than 1:8 with from about 0.25 to 5% by weight, based on the weight of the textile, of an addition product of a bisulphite and a polyisocyanate, and the textile is then rinsed with water, and (c) in a third stage, the textile is dried by a known method and after-treated with steam, the aqueous liquor used in the first and/or second stage containing from about 0.5 to 10 g/l of salts of polyvalent metals.

2. A process according to claim 1, characterized in that the proportion by weight of textile to be treated and aqueous treatment baths lies in the range of from about 1:10 to 1:60.

3. A process according to claim 1 or 2, characterized in that the textile is rinsed with water before the second stage in order to remove excess quantities of compounds containing cationic groups.

4. A process according to claim 1 or 2, characterized in that the salts of polyvalent metals used are a mixture of calcium chloride and magnesium chloride.

5. A process according to claim 4, characterized in that the calcium chloride and magnesium chloride are used in a weight ratio of about 1:3.

6. A process according to claim 1 or 2, characterized in that the pH of the treatment bath is from about 7.1 to 8.5.

7. A process according to claim 1 or 2, characterized in that the compounds which have cationic groups are cationic polyurethanes, reaction products of a polyamine with an excess of phthalic acid, quaternary ammonium salts corresponding to the following general formula:

$$\left[ C_nH_{(2n+1)}-\overset{\overset{R_1}{|}}{\underset{\underset{R_2}{|}}{N}}{}^{\oplus}-R_3 \right] X^{\ominus}$$

wherein n represents an integer of from 6 to 20, $R_1$ and $R_2$ represent hydrogen or an alkyl group having from 1 to 3 carbon atoms and $R_3$ represents an alkyl, cycloalkyl, aryl or aralkyl group having from 1 to 15 carbon atoms, and X is any anion, or reaction products of a ditertiary diamine and an alkylene dihalide or quaternary reaction products of a polyamine and epichlorohydrin.

8. A process according to claim 1 or 2 characterized in that the bisulphite adducts of isocyanate prepolymers are based on polyethers or polyesters containing two or three hydroxyl groups and having a molecular weight of from about 500 to 10,000 are used.

9. A process according to claim 1 or 2, characterized in that from about 0.5 to 6% by weight, based on the textile material, of a polyurethane having anionic groups are added to the treatment bath in the second stage of the process.

10. The process of claim 1, wherein the long bath of step (b) also contains about 0.5 to 6 wt.%, based on the weight of the textile, of a water soluble or dispersible anionic polyurethane.

* * * * *